US006780009B2

(12) United States Patent
Harneit

(10) Patent No.: US 6,780,009 B2
(45) Date of Patent: Aug. 24, 2004

(54) GAS BURNER HEAD ASSEMBLY

(76) Inventor: Uwe Harneit, 1466 W. Francis Ave., Ontario, CA (US) 91762-6016

( * ) Notice: Subject to any disclaimer, the term of this patent is extended or adjusted under 35 U.S.C. 154(b) by 0 days.

(21) Appl. No.: 10/679,840

(22) Filed: Oct. 6, 2003

(65) Prior Publication Data

US 2004/0072112 A1 Apr. 15, 2004

Related U.S. Application Data

(60) Provisional application No. 60/417,014, filed on Oct. 9, 2002.

(51) Int. Cl.[7] ..... F23D 14/62; F23Q 3/00

(52) U.S. Cl. ..... 431/354; 431/266; 126/39 E; 239/552

(58) Field of Search ..... 431/354, 266, 431/286, 349; 126/39 E, 39 BA; 239/552, 556

(56) References Cited

U.S. PATENT DOCUMENTS 6,067,978 A * 5/2000 Schlosser et al. ..... 126/41 R
6,244,263 B1 6/2001 Schlosser et al.
6,589,046 B2 * 7/2003 Harneit ..... 431/266
6,607,378 B2 * 8/2003 Harneit et al. ..... 431/354

* cited by examiner

*Primary Examiner*—Alfred Basichas
(74) *Attorney, Agent, or Firm*—Lewis M. Brande; Thomas A. McCleary; Brande and McCleary

(57) ABSTRACT

A burner head and a burner cap each being generally disc shaped are fixedly attached to each other creating an improved burner head assembly and creating a distribution chamber therebetween. The burner head has main and secondary flame holes that communicate with the distribution chamber and the environment. The burner head assembly has feet that positively locate and position the burner head assembly onto a burner base, where the burner base has provisions to integrally mate with the burner head assembly.

5 Claims, 2 Drawing Sheets

GAS BURNER HEAD ASSEMBLY

This application claims benefit of 60/417,014 filed Oct. 9, 2002.

BACKGROUND OF THE INVENTION

Field of the Invention

Multi-part gas burners are one style of burners that are used for outdoor cooking. Normally these multi-part gas burners need to be dismantled and cleaned on a regular basis in order to guarantee that they will operate in an efficient manner.

Most burner assemblies will consist of a burner base, a burner head or burner ring, and a burner cap. Generally, the fuel is injected into the burner base, where it is mixed with air to create a flammable fuel air mixture. The fuel air mixture is then transported to a chamber between the burner head and the burner cap where it is distributed to a series of holes that are circumferentially arranged on the circumference of the burner head. These holes allow the fuel air mixture to escape and be ignited by an igniter. On many burners there are 2 series of holes that allow the fuel air mixture to escape. The first series of smaller holes is to provide both a good low flame and a sustaining flame, while the second series of holes are larger and provide an excellent main flame for the majority of cooking. The smaller holes also provide a reignite feature for the second series of holes, the main flame holes.

A primary disadvantage of some burner designs is that the burner head is loosely placed upon the burner base, with minimal orientation provisions, and with minimal provisions for positioning the burner head on the burner base. This would allow the burner head to be mis-positioned on the burner base, causing a loss of flammable gas or in a worst case situation, a potential for explosion. The burner cap in some of these burner assemblies is loosely placed on the top of the burner head. Many of the burner caps do not have any positive feature to guarantee that the burner cap is fixed in the optimal, or even correct position. The problems are compounded when the burner cap and/or burner head are made from lightweight materials. Many of the problems described would occur when the appliance is moved, which would cause the burner assembly's components to be dislodged from their static positions.

In order to prevent the burner head from being dislodged from the burner base, positioning blades would be added, which would prevent the burner head from moving out of alignment. Additionally, the burner cap would be positively fixed onto the burner head, creating a burner head assembly, thereby preventing the burner head or burner cap from being dislodged out of alignment.

U.S. Pat. No. 6,244,263 by Schlosser et al. is a good example of the state of the art in burners. A burner head base plate has provisions to insertably receive pins that are installed on the burner cap. A burner ring is interspaced between the burner head and the burner base plate. This system is fabricated from a relatively heavy material, such as brass. This guarantees that the burner assembly will not become easily dislodged.

SUMMARY OF THE INVENTION

The present invention remedies some of the shortcomings of the field of the art in burner head assemblies.

On burner head assemblies that are made from very light materials like aluminu,m especially in very thin gages, there is a tendency for the burner cap and/or burner head to become dislodged as they rely upon their own weight to prevent unwanted disassembly. The primary aspect of the invention is to positively secure the burner head to the burner ring, creating a much more secure device. The burner ring will have incorporated within it, a positive positioning feature that will interface with a corresponding complementary feature in the burner base. These two features will greatly reduce mis-orientation problems, and unintentional dislodging problems.

DETAILED DESCRIPTION

Figure 1:
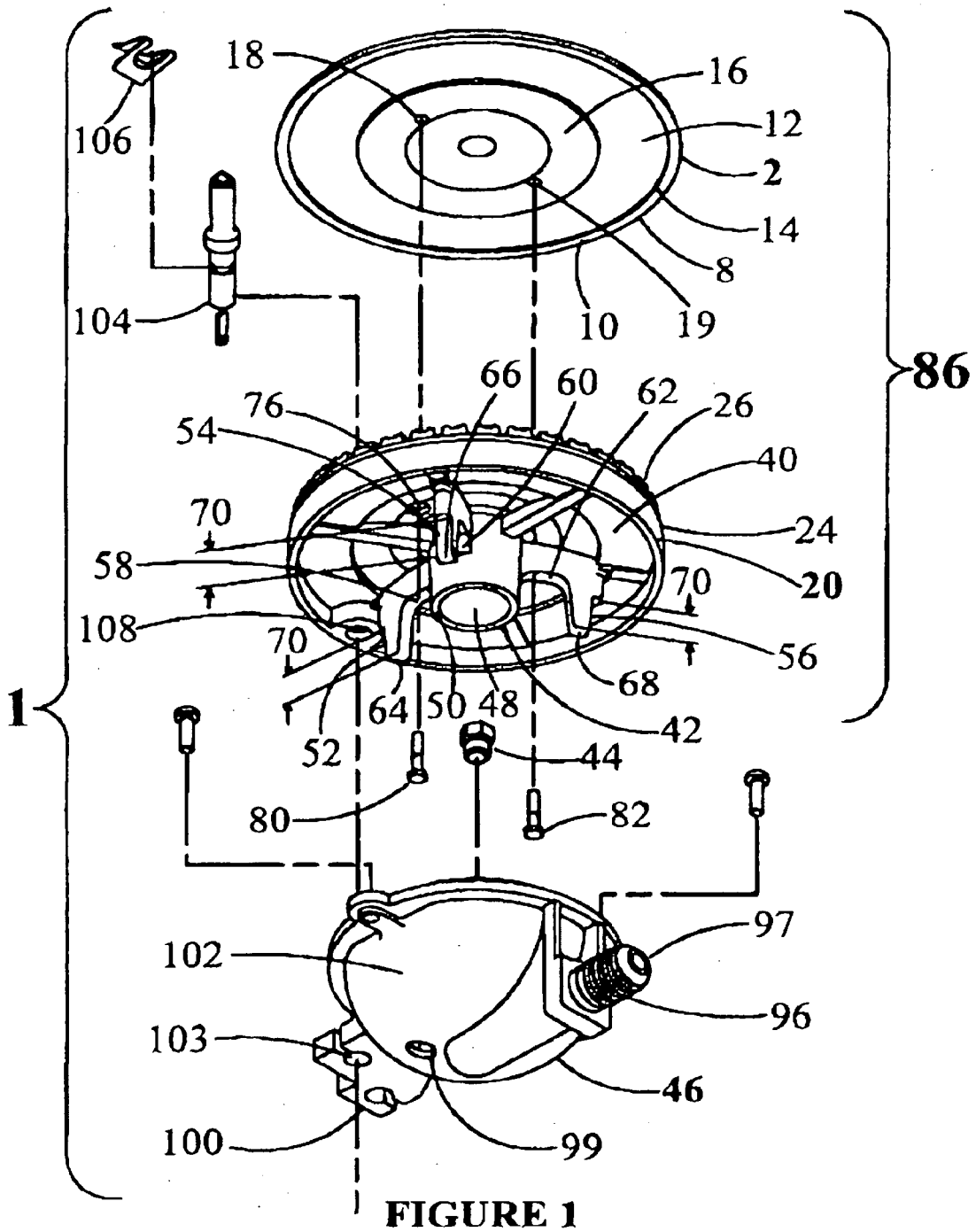
FIG. 1 shows an exploded view of the burner assembly, in a view looking in an upward direction
Figure 2:
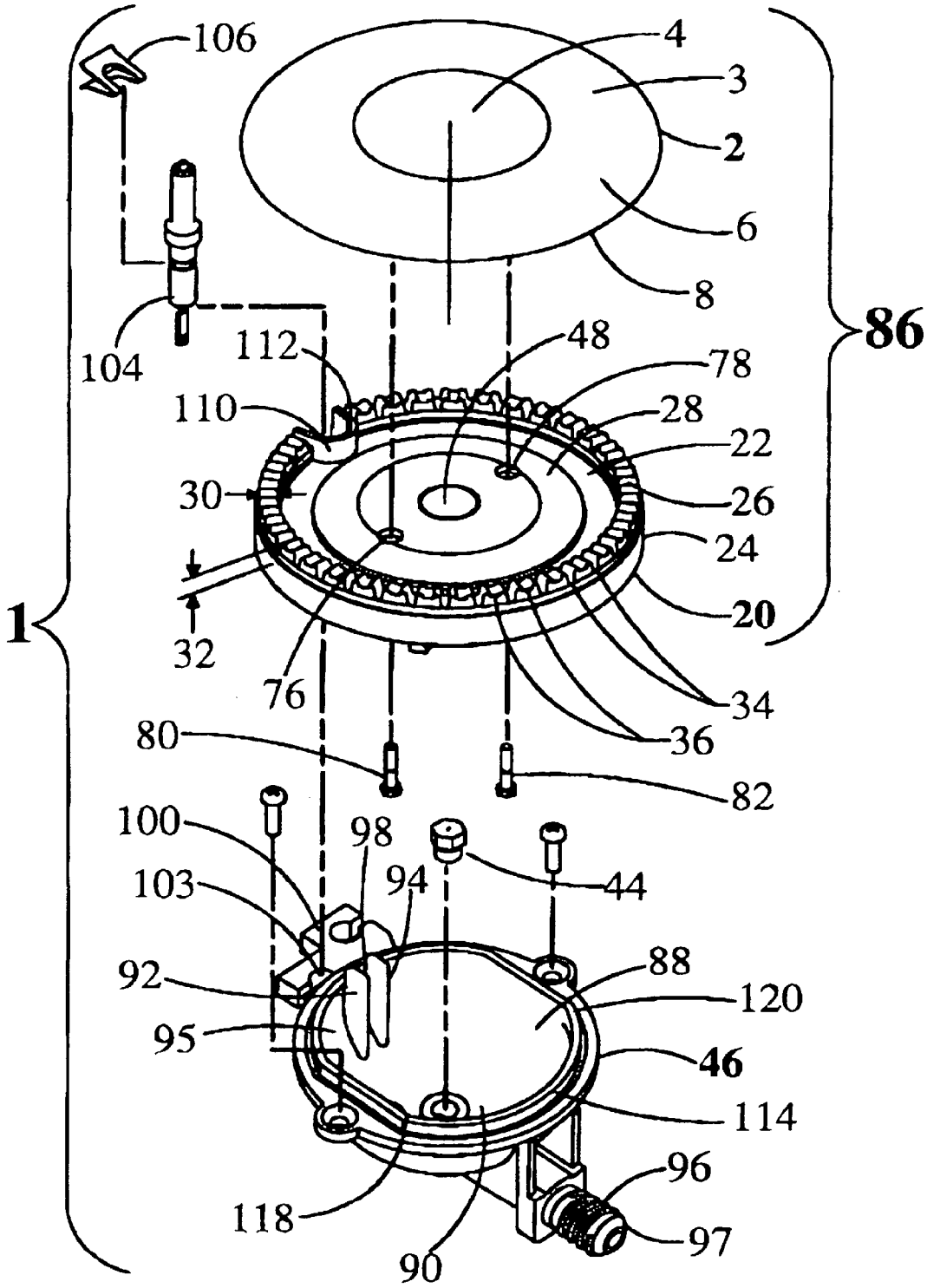
FIG. 2 shows an exploded view of the burner assembly, in a view looking in a downward direction.

The burner assembly (1) for this invention includes a burner cap (2), the burner cap (2) being essentially disc shaped, and having a top (3), the top (3) having included thereon a horizontal surface (4), the horizontal surface (4) being centrally located. Also included on the top (3) is a tapering surface (6), the tapering surface (6) extending from the horizontal surface (4) and terminating at an edge (8) of the top. The tapering surface (6) allows dirt and liquid to drain away from the central portion of the burner cap (2). The edge (8) of the burner cap (2) has a down turned flange or lip (10) that overhangs the edge (8) of the burner cap (2). The burner cap (2) has a bottom surface (12), the bottom surface (12) being recessed away from the down turned flange or lip (10), creating a recessed portion (14) of the bottom surface (12). Centrally located on the bottom surface (12) of the burner cap (2) is a raised boss (16), the raised boss (16) being circular in this embodiment. The raised boss (16) provides a thicker cross sectional area, and has a first and second threaded hole (18, 19) defined therein.

A burner head (20) is shown being essentially circular in shape, which is complimentary to the shape of the burner cap (2). The burner head (20) is shown as essentially a flat plate and having a top surface (22). The burner head (20) has an edge (24) defined on the outer portion of the burner head (20). On the edge (24) of the burner cap (2), a first annular boss (26) is positioned, projecting upwards, creating a central cavity (28) therein. The first annular boss (26) is defined as having a thickness (30) and a height (32).

A series of main flame slots (34) is defined therein. A series of secondary flame slots (36) are also defined therein, and are interspaced between each pair of main flame slots (34). The main flame slots (34) are cut deeper into the first annular boss (26) than the secondary flame slots (36). The burner head (20) has a bottom surface (40). Centrally located on the bottom surface is a second annular boss (42). The second annular boss (42) projects downwards and is positioned over a gas jet (44) located in a burner base (46). The second annular boss (42) has a centrally located hole (48) defined therein. The centrally located hole (48) penetrates through the top surface (22) of the burner head (2). The centrally located hole (48) may be cylindrically shaped, or it may be tapered, towards the top surface (22) where the taper is smaller at the top surface (22) than at a bottom (50) of the second annular boss (42).

This embodiment of burner head (20) shows at least three (3) pads, a first pad (52), a second pad (54), and a third pad (56), radiating away from the second annular boss (42). The first, second, and third pads (52, 54, 56), have a first, second and third foot (58, 60, 62) where the first, second and third feet (58, 60, 62) provides a stable base to rest upon the burner base (46). Projecting downwards from the first, second and third foot (58, 60, 62), is a first, second and third positioning blade (64, 66, 68).

The first, second and third positioning blade (64, 66, 68), each have a length (70), where the length (70) of the first second and third positioning blade (64, 66, 68), is great enough to prevent the burner head (20) from being dislodged when the appliance that has the burner assembly (1) installed, is transported over uneven ground, which would cause the appliance to be bounced, and or rocked.

The top surface (22) of the burner head (20) has a first hole (76), and a second hole (78) defined therein. The first and second hole (76, 78) are located coincident with the first and second threaded holes (18, 19) which are located in the burner cap (2), such that the burner cap (2) is engaged against the thickness (30) of the first annular boss (26) of the burner head (20) by the first threaded pin (80) and second threaded pin (82), creating a distribution chamber (not shown) between the bottom surface (12) of the burner cap (2) and the central cavity (28) of the burner. The distribution chamber (not shown) allows the fuel-air mixture to flow through the main flame slots (34), and the secondary flame slots (36).

The burner base (46) as defined in the present disclosure is generally cup shaped. The cup shaped burner base (46) has a mixing chamber (88) defined therein. The mixing chamber (88) has a bottom (90). At the bottom (90) of the mixing chamber (88) a weep hole (99) is located, the weep hole (99) allowing water and dirt to exit therefrom. A gas inlet (97) is defined as a cylindrical tube having a threaded portion (96) and allowing gas to be inserted into the mixing chamber (88) through the gas jet (44), the gas jet (44) being centrally located at the bottom (90) of the mixing chamber (88) and being also being located below the second annular boss (42) and hence the centrally located hole (48) when the burner head assembly (86) is positioned thereupon.

A first blade (92) and a second blade (94) are positioned in a parallel relationship to each other creating a orientation slot (98), where the orientation slot is attached to a wall (95) of the mixing chamber (88). The orientation slot (98) positions the burner head assembly (86) in the proper position on the burner base (46). In order to facilitate improved fit between the burner head assembly (86) and the burner base (46), the burner base (46) has a first corner (118) and a second corner (120) defined therein. The first corner (118) provides a hard location for the second positioning bade (66), and the second corner (120) provides a hard location for the third positioning blade (68). A pad (100) protrudes outwards from an outer surface (102) of the burner base (46). The pad (100) has a hole (103) defined therein, where the hole (103) insertably receives an igniter (104) therein. The igniter (104) is held in proper position by a spring clip (106).

The first annular boss (26) of the burner head (20) additionally has a igniter hole (108) defined therein. A wall (110) extends to the height (32) of the first annular boss (26) creating the wall (110) thereupon. The wall (110) prevents flammable gas from escaping the distribution chamber (not shown). The wall (110) has a small slot (112) defined therein to allow a spark from the igniter (104) to ignite the flammable gas. The burner head assembly (86) is positioned on the burner base (46) by slidably inserting the first positioning blade (64) into the orientation slot (98), allowing the igniter (104) to be inserted through the igniter hole (108). The first pad (52), the second pad (54) and third pad (56) rest upon an upper edge (114) of the burner base (46) creating a gap (not shown) therebetween, allowing air to enter the mixing chamber (88) and intermix with the flammable gas from the gas jet (44). The intermixed flammable gas is transported through the centrally located hole (48) of the second annular boss (42) and enters into the distribution chamber (not shown) where it is pushed through the main flame slots (34) and the secondary flame slots (36) via positive pressure from the burner base (46).

Although the burner cap (2) may be made from a variety of heat resistant materials, the best materials would be metals with a density greater than aluminum. Materials such as brass and steel would be premium choices, as they would provide the greatest weight and also the greatest stability to the burner assembly (86) when installed onto the burner base (46).

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An improved gas burner head assembly, comprising:

a. a burner cap, said burner cap being disc shaped, said burner cap having a top, said top of said burner cap having included thereon a centrally located horizontal surface and a tapering surface, said tapering surface extending from said horizontal surface and terminating at an edge of said top of said burner cap;

b. said edge of said top of said burner cap having defined thereon a downturned flange or lip, said lip overhanging said edge of said burner cap, said burner cap further having a bottom surface, said bottom surface being recessed away from said lip creating a recessed portion of said bottom surface thereon, a raised boss, said raised boss being centrally located on said bottom surface of said burner cap, said raised boss having a first hole and a second hole defined therein;

c. a burner head, said burner head being complimentary in shape to said burner cap, said burner head being defined as a flat plate, said flat plate having a top surface and a bottom surface defined thereon, a first annular boss is defined on an outer portion of said burner head and projecting upwards creating a central cavity thereby, said first annular boss having a thickness and a height;

d. said first annular boss has a series of main flame slots and secondary flame slots defined therein, a second annular boss is centrally located on said bottom surface of said burner head and projects downward to be positioned over a gas jet, said gas jet being located in a burner base;

e. said second annular boss has a centrally located hole defined therein, said centrally located hole penetrating through said top surface of said burner head;

f. said burner head having a plurality of pads, said plurality of pads radiating away from said second annular boss, said plurality of pads each having a foot defined thereon, said foot creating a stable support to rest upon said burner base, a positioning blade is positioned on each of said feet, and projects in a downward orientation;

g. each of said positioning blades has a length, said length preventing said burner head from being dislodged from said burner base;

h. said top surface of said burner head has a first hole and a second hole defined therein, said first and said second hole each being coincidently positioned with said first and said second holes in said burner cap, a first and second pin means is inserted into said first and second hole located in said burner head respectfully, and is positionally engaged with said first and second hole in said burner cap, creating a burner head assembly, said bottom surface of said burner cap and said central cavity of said burner head defining a distribution chamber therebetween, said distribution chamber communicating with the external environment via said main flame slots and said secondary flame slots;

i. a burner base, said burner base being shaped to define a mixing chamber therein, said mixing chamber having a bottom, said bottom of said mixing chamber having a weep hole defined therein, said weep hole permitting water and dirt to exit therefrom, said burner base further having a gas inlet defined thereon, said gas inlet allowing flammable gas to be inserted into said mixing chamber through a gas jet, said gas jet being located below said second annular boss in said burner head assembly; and j. said burner base having a first blade and a second blade orthogonally arranged in a parallel relationship creating an orientation slot therebetween, said first and second blade being attached to a wall of said mixing chamber, said orientation slot positionally arranges said burner head assembly on said burner base, a first corner and a second corner being defined on said burner base and each locating one of said positioning blades thereby, said burner base having a locating means for an igniter, said burner head additionally having an igniter positioning means therein positionally aligned with said locating means for an igniter.

2. The improved burner head assembly of claim 1 wherein;

a. said first hole and said second hole in said burner head being threadably defined as a first and second threaded hole; and b. said first and second fastening means being defined as a first and second threaded fastener, said first and second threaded fastener being threadably engaged in said first and second threaded holes in said burner head.

3. The improved burner head assembly of claim 1 wherein;

a. said locating means on said burner base has a pad defined thereon, said pad protruding outwards from an outer surface of said burner base, said base having a hole defined therein, said hole insertably receiving an igniter therein;

b. said first annular boss of said burner head has an igniter hole defined therein, said igniter hole being coincidentally located with said hole in said burner base, a wall extends from said burner head to the height of said first annular boss creating a semicircular slot thereon, said wall further having a slot defined therein, said slot allowing a spark to ignite said flammable gas in said distribution chamber.

4. The improved burner head assembly of claim 1 wherein said plurality of said blades is three.

5. The improved burner head assembly of claim 1 wherein said pin means being defined as threaded pins, said threaded pins being threadably engaged in said first and second holes in said burner head, said first and second holes in said burner cap being co-incidently aligned with said first and second threaded pins threadably engaged in said burner head, allowing engagement against said bottom surface of said burner cap, creating a distribution changer therebetween.

* * * * *